US012421818B2

(12) United States Patent
Hofacker et al.

(10) Patent No.: US 12,421,818 B2
(45) **Date of Patent: *Sep. 23, 2025**

(54) SYSTEM AND METHOD FOR ELECTRONICALLY CONTROLLING DOWNHOLE VALVE SYSTEM

(71) Applicant: Schlumberger Technology Corporation, Sugar Land, TX (US)

(72) Inventors: Mark Hofacker, Sugar Land, TX (US); Jordi Juan Segura Dominguez, Tananger (NO); Jeffrey Conner McCabe, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/675,657

(22) Filed: May 28, 2024

(65) Prior Publication Data

US 2024/0309717 A1 Sep. 19, 2024

Related U.S. Application Data

(62) Division of application No. 17/657,523, filed on Mar. 31, 2022, now Pat. No. 11,993,991.

(51) Int. Cl.

| | |
|---|---|
| ***E21B 23/06*** | (2006.01) |
| ***E21B 33/124*** | (2006.01) |
| *E21B 47/06* | (2012.01) |

(52) U.S. Cl.

CPC ..... *E21B 23/06* (2013.01); *E21B 33/1243* (2013.01); *E21B 47/06* (2013.01)

(58) Field of Classification Search

CPC ..... E21B 34/006; E21B 33/127; E21B 23/06; E21B 33/1243; E21B 47/06

See application file for complete search history.

(56) References Cited

U.S. PATENT DOCUMENTS

| | | | |
|---|---|---|---|
| 4,913,231 | A | 4/1990 | Muller |
| 6,176,318 | B1 | 1/2001 | Drakeley |

(Continued)

FOREIGN PATENT DOCUMENTS

| | | | |
|---|---|---|---|
| CN | 206458407 | U | 9/2017 |
| EP | 2281105 | B1 | 12/2018 |

(Continued)

OTHER PUBLICATIONS

Office Action issued in U.S. Appl. No. 17/657,514 dated Nov. 23, 2022, 9 pages.

(Continued)

*Primary Examiner* — Yong-Suk (Philip) Ro
(74) *Attorney, Agent, or Firm* — Rushi C. Sukhavasi

(57) ABSTRACT

A technique facilitates control over packers and/or other well tools actuated downhole. The technique utilizes a valve connectable into a well string. The valve is shiftable between a plurality of modes so as to control flow of fluid in a downhole environment. Additionally, an actuator system is connectable into the well string and operatively coupled with the valve. The actuator system is electronically controlled to cause the valve to shift to a desired mode of the plurality of modes. This approach enables electronic control over the actuation of specific downhole tools, e.g. packers, and/or other well related operations.

11 Claims, 6 Drawing Sheets

(56) References Cited

U.S. PATENT DOCUMENTS

| | | | | |
|---|---|---|---|---|
| 6,543,544 | B2 | 4/2003 | Schultz | |
| 7,051,810 | B2 | 5/2006 | Clemens | |
| 7,967,067 | B2 | 6/2011 | Irani | |
| 9,890,611 | B2 | 2/2018 | Lee | |
| 10,006,282 | B2 | 6/2018 | Livescu | |
| 10,385,680 | B2 | 8/2019 | Livescu | |
| 10,876,377 | B2 | 12/2020 | Quero | |
| 10,947,794 | B2 | 3/2021 | Noui-Mehidi | |
| 11,591,871 | B1 * | 2/2023 | Randall | E21B 33/129 |
| 2004/0026086 | A1 | 2/2004 | Patel | |
| 2007/0295515 | A1 | 12/2007 | Veneruso | |
| 2009/0114447 | A1 | 5/2009 | Reid, Jr. | |
| 2011/0147086 | A1 | 6/2011 | Hummes | |
| 2011/0168403 | A1 | 7/2011 | Patel | |
| 2012/0048561 | A1 | 3/2012 | Holderman | |
| 2012/0085539 | A1 | 4/2012 | Tønnessen | |
| 2013/0014939 | A1 | 1/2013 | Martinez | |
| 2013/0192848 | A1 | 8/2013 | Patel | |
| 2013/0206401 | A1 | 8/2013 | Bhoite | |
| 2014/0083689 | A1 | 3/2014 | Streich | |
| 2014/0196953 | A1 | 7/2014 | Chitwood | |
| 2014/0352955 | A1 | 12/2014 | Tubel | |
| 2015/0027724 | A1 * | 1/2015 | Symms | E21B 34/16 166/373 |
| 2015/0136425 | A1 | 5/2015 | Burgos | |
| 2015/0308264 | A1 * | 10/2015 | Zuo | E21B 49/088 702/6 |
| 2016/0024899 | A1 * | 1/2016 | Lynn | E21B 43/26 166/305.1 |
| 2016/0115753 | A1 | 4/2016 | Frazier | |
| 2017/0191346 | A1 | 7/2017 | Nicholson | |
| 2017/0260834 | A1 | 9/2017 | Chacon | |
| 2017/0284168 | A1 | 10/2017 | Zevenbergen | |
| 2017/0292353 | A1 | 10/2017 | Liu | |
| 2018/0023358 | A1 | 1/2018 | Moyes | |
| 2018/0094490 | A1 | 4/2018 | Lines | |
| 2018/0245428 | A1 | 8/2018 | Richards | |
| 2018/0274331 | A1 | 9/2018 | Richards | |
| 2018/0347350 | A1 | 12/2018 | Frith | |
| 2019/0203538 | A1 | 7/2019 | Wisinger Jr. | |
| 2019/0226294 | A1 | 7/2019 | Hansen | |
| 2019/0316440 | A1 | 10/2019 | Honeker | |
| 2020/0115992 | A1 | 4/2020 | Wang | |
| 2020/0217197 | A1 | 7/2020 | Adebiyi | |
| 2020/0332613 | A1 | 10/2020 | Al Hussin | |
| 2021/0131224 | A1 | 5/2021 | Radford | |
| 2021/0254431 | A1 | 8/2021 | Prost | |
| 2021/0320578 | A1 | 10/2021 | Sheth | |

FOREIGN PATENT DOCUMENTS

| | | | |
|---|---|---|---|
| EP | 3268831 | | 9/2020 |
| WO | WO03018955 | A1 | 3/2003 |
| WO | WO2022016023 | A2 | 1/2022 |

OTHER PUBLICATIONS

Office Action issued in U.S. Appl. No. 17/657,514 dated May 3, 2023, 10 pages.

International Search Report and Written Opinion issued in International Patent application PCT/US2023/017018 dated Jul. 28, 2023, 11 pages.

International Search Report and Written Opinion issued in International Patent application PCT/US2023/017022 dated Jul. 12, 2023, 11 pages.

International Search Report and Written Opinion issued in International Patent application PCT/US2023/016801 dated Jul. 12, 2023, 10 pages.

Office Action issued in U.S. Appl. No. 17/657,499 dated Oct. 5, 2023, 32 pages.

Office Action issued in U.S. Appl. No. 17/657,499 dated Aug. 9, 2024, 24 pages.

* cited by examiner

SYSTEM AND METHOD FOR ELECTRONICALLY CONTROLLING DOWNHOLE VALVE SYSTEM

BACKGROUND

In many well applications, a well string is deployed downhole into a borehole, e.g. a wellbore. A given well string may comprise packers and other well tools which are actuated downhole. For example, packers may be expanded downhole to establish a seal between the well string and a surrounding wellbore wall, e.g. a surrounding well casing. Traditional methods for actuating downhole packers and other well tools often included dropping a ball from the surface down to a ball seat associated with a given packer/well tool. Appropriate pressure may then be applied down through the well string to cause well tool actuation. For example, pressure can be applied to the dropped ball to shift a valve which, in turn, would direct fluid flow to inflate or otherwise actuate a packer. Other types of downhole actuation rely on complex mechanical valves operated via pumping pressure or involve mechanically pushing or pulling on well tubing, e.g. coiled tubing, to achieve the desired downhole well tool actuation. However, such methods tend to be complex and time-consuming.

SUMMARY

In general, a system and methodology facilitate control over packers and/or other well tools actuated downhole. The technique utilizes a valve connectable into a well string. The valve is shiftable between a plurality of modes so as to control flow of fluid in a downhole environment. Additionally, an actuator system is connectable into the well string and operatively coupled with the valve. The actuator system is electronically controlled to cause the valve to shift to a desired mode of the plurality of modes. This approach enables electronic control over the actuation of specific downhole tools, e.g. packers, and/or other well related operations.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology facilitate control over packers and/or other well tools actuated downhole. The technique utilizes a valve connectable into a well string. The valve is shiftable between a plurality of modes so as to control flow of fluid in a downhole environment. By way of example, the valve may be selectively controlled via electronic input to provide appropriate modes for deploying and actuating inflatable packer elements in a well. The valve may be used to inflate a single packer element or to inflate a plurality of packer elements, e.g. a set of straddle packers used to isolate a treatment zone. In some embodiments, the valve may be selectively actuated to a mode which enables pumping of treatment fluid into the straddled zone.

An actuator system may be connected into the well string and operatively coupled with the valve. The actuator system is electronically controlled to cause the valve to shift to a desired mode of the plurality of modes. This approach enables electronic control over the actuation of specific downhole tools, e.g. packers, and/or other well related operations. By way of example, the actuator system may be used to shift the valve between three modes or operational positions in which fluid is directed out to the annulus above the packers for recirculation; into the packers for inflation; or below/between the packers for a treatment injection. The overall valve system also may be instrumented to monitor valve actuation, e.g. to monitor pressures in the different areas where the fluid is being pumped and/or trapped. The use of pressure monitoring enables precise observation of differential pressures to ensure, for example, integrity of the packers.

Figure 1:
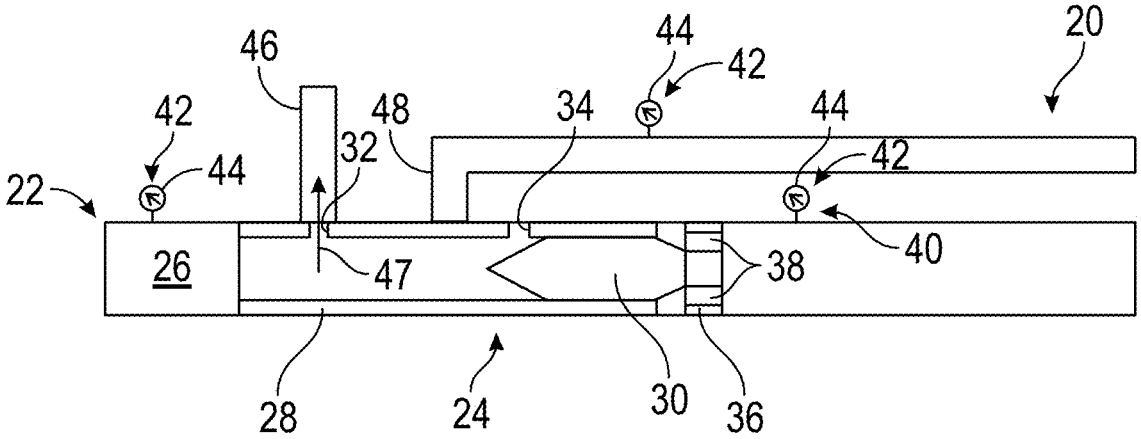
FIG. 1 is a schematic illustration of an example of a well system having a valve deployed along a well string, according to an embodiment of the disclosure.

Referring generally to FIG. 1, an example of a well system 20 is illustrated as deployed along a well string 22. Well system 20 comprises a valve 24 shiftable between a plurality of operational positions to control fluid flows directed along an interior 26 of the well string 22. By way of example, the valve 24 may comprise an outer piston 28 which is selectively movable/shiftable with respect to an inner piston sealing structure 30 so as to achieve different valve positions and thus different operational modes.

According to an embodiment, the piston 28 may be tubular in shape and comprise a plurality of lateral openings, e.g. lateral openings 32 and 34. The inner piston sealing structure 30 is sized and shaped to enable sealing engagement with an interior surface of the piston 28. Depending on the configuration of well string 22 and valve 24, the inner piston sealing structure 30 may be secured via a mounting structure 36 having flow passages 38. By way of example, the mounting structure 36 may be secured within an outer valve housing or within a corresponding tubular structure of the well string 22.

A sensor system 40 also may be incorporated into the well string 22 and may comprise a plurality of sensors 42. In some embodiments, the sensors 42 may comprise pressure sensors 44 positioned at different locations with respect to valve 24 so as to monitor pressures and differential pressures of, for example, fluid being pumped and/or fluid trapped at specific areas.

Depending on the specific application, the valve 24 may be constructed as shiftable between modes which include a circulation mode, a packer inflation mode, and a treatment mode. Referring to FIG. 1, for example, the valve 24 is illustrated as a three way valve positioned in the circulation mode. In this mode, valve 24 is shifted such that tubular piston 28 is engaged with inner piston sealing structure 30 so as to prevent fluid from flowing past structure 30. Additionally, lateral opening 34 is misaligned while lateral opening 32 is aligned with circulation passage 46, thus enabling circulation of fluid down through well string 22, out through lateral opening 32/passage 46 (see arrow 47), and then back up through an annulus between well string 22 and a surrounding wellbore wall.

Figure 2:
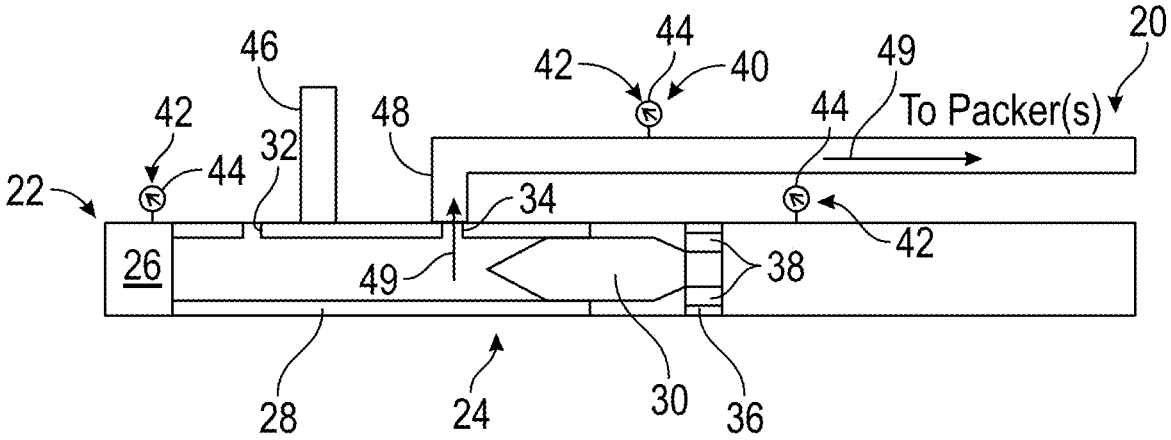
FIG. 2 is a schematic illustration of the well system illustrated in FIG. 1 but showing the valve in a different operational position, according to an embodiment of the disclosure.

By shifting the outer piston 28 longitudinally, as illustrated in FIG. 2, the valve 24 is shifted to a packer inflation mode. In this configuration, outer piston 28 remains engaged with inner piston sealing structure 30. However, lateral opening 32 becomes misaligned while lateral opening 34 is aligned with a packer inflation passage 48. This enables circulation of fluid down through well string 22, out through lateral opening 34/inflation passage 48, and to a packer or packers (not shown) to inflate the packer(s) into sealing engagement with the surrounding wellbore wall (see arrows 49).

Figure 3:
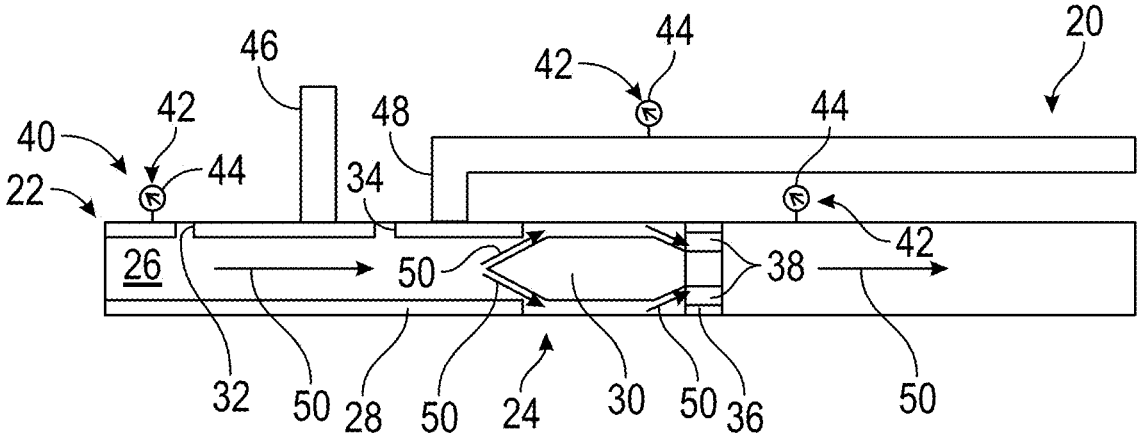
FIG. 3 is a schematic illustration of the well system illustrated in FIG. 2 but showing the valve in the different operational position, according to an embodiment of the disclosure.

By further shifting the outer piston 28 longitudinally, as illustrated in FIG. 3, the valve 24 is shifted to a well treatment mode. In this configuration, outer piston 28 disengages from inner piston sealing structure 30 so as to allow treatment fluid to flow past the inner piston sealing structure 30 (see arrows 50) for subsequent injection into the surrounding formation. In the well treatment mode, both lateral opening 32 and lateral opening 34 become misaligned to block lateral fluid flow and to thus ensure the treatment fluid flows downhole past valve 24.

Figure 4:
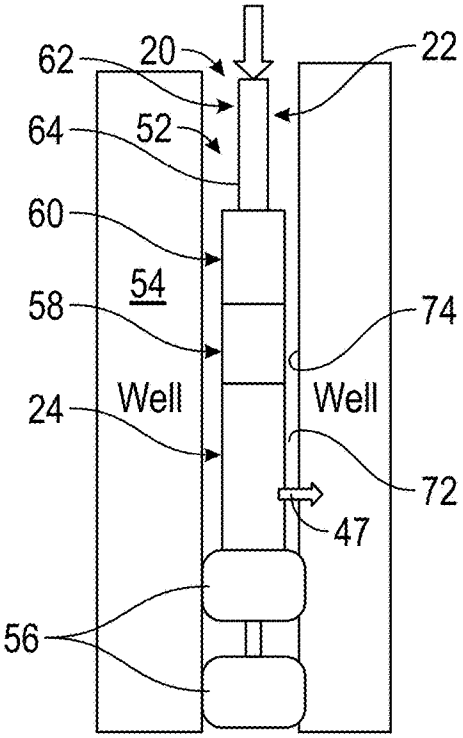
FIG. 4 is a schematic illustration of a well system having a well string deployed via coiled tubing and comprising the valve in a first operational position, according to an embodiment of the disclosure.

Referring generally to FIG. 4, an embodiment of well system 20 is illustrated in which well string 22 is deployed in a wellbore 52 or other type of borehole drilled into a surrounding formation 54. In this example, the well string 22 comprises a plurality of packers 56, e.g. two packers arranged in a straddle packer configuration as illustrated. Along with packers 56, the well string 22 comprises valve 24 which is controlled via an electronically controlled actuation system 58. The actuation system 58 may be positioned along well string 22 adjacent valve 24 or at another suitable location.

The actuation system 58 responds to electric control signals provided via controller 60. Controller 60 may receive commands from the surface and/or may be programmed to provide certain control commands to actuation system 58, and thus valve 24. For example, controller 60 may be programmed to respond according to parameters sensed downhole via, for example, sensor system 40. The controller 60 is illustrated as located downhole along well string 22, however the controller 60 also can be located at the surface or at other locations along the well string.

In this example, the packers 56 and other well equipment of well string 22 are deployed downhole via tubing 62. In a variety of applications, the tubing 62 may be in the form of coiled tubing 64.

Figure 5:
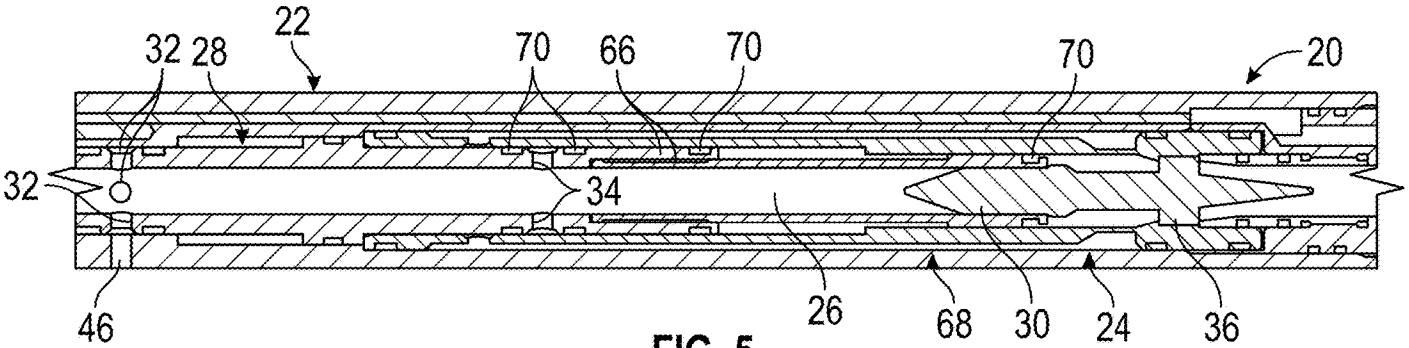
FIG. 5 is a cross-sectional illustration of an example of the valve illustrated in FIG. 4, according to an embodiment of the disclosure.
Figure 6:
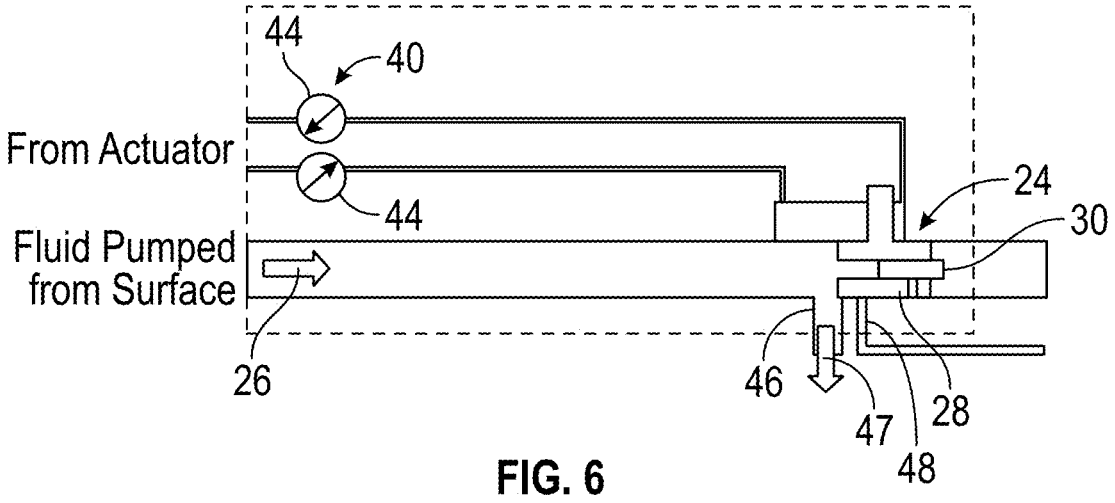
FIG. 6 is a schematic illustration of an example of the valve illustrated in FIG. 4, according to an embodiment of the disclosure.

In FIG. 4, the valve 24 is positioned in the circulation mode, as further illustrated by FIGS. 5 and 6. In this embodiment, the tubular outer piston 28 comprises a plurality of piston components 66 which slide within a surrounding valve housing 68. Appropriate seals 70 may be positioned about the outer piston 28. The inner piston sealing structure 30 is affixed to the surrounding valve housing 68 via mounting structure 36. In this example, lateral opening 32 comprises a plurality of lateral openings and lateral opening 34 similarly comprises a plurality of lateral openings.

In the circulation mode, valve 24 is shifted such that tubular piston 28 is engaged with inner piston sealing structure 30 so as to prevent fluid from flowing past structure 30. Additionally, lateral openings 34 are misaligned while lateral openings 32 are aligned with corresponding circulation passages 46, thus enabling circulation of fluid down through well string 22, e.g. down through coiled tubing 64, out through lateral openings 32/passages 46 (see arrows 47 in FIG. 6), and then along an annulus 72 between well string 22 and a surrounding wellbore wall 74 of wellbore 52 (see FIG. 4). The pressure sensors 44 (or other suitable sensors) may be used to monitor pressures on each side of piston 28 and to provide this differential pressure feedback to controller 60 and/or to a surface control system to enable monitoring of the position of valve 24.

Figure 7:
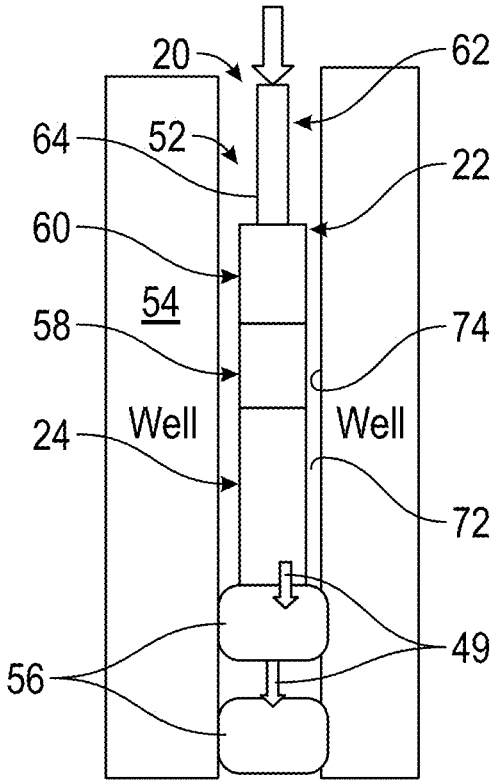
FIG. 7 is a schematic illustration of a well system having a well string deployed via coiled tubing and comprising the valve in a second operational position, according to an embodiment of the disclosure.
Figure 8:
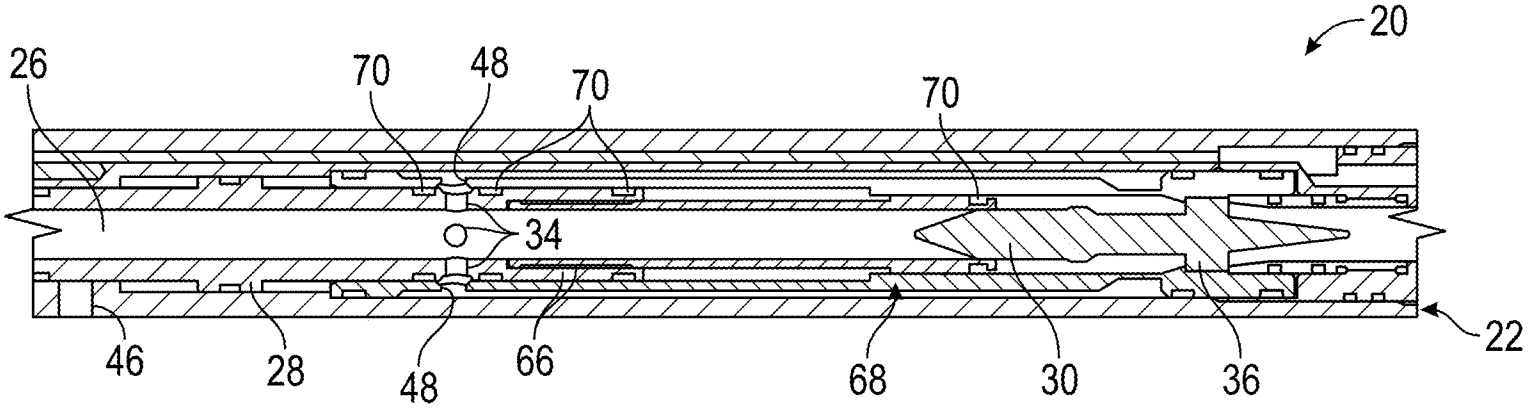
FIG. 8 is a cross-sectional illustration of an example of the valve illustrated in FIG. 7, according to an embodiment of the disclosure.
Figure 9:
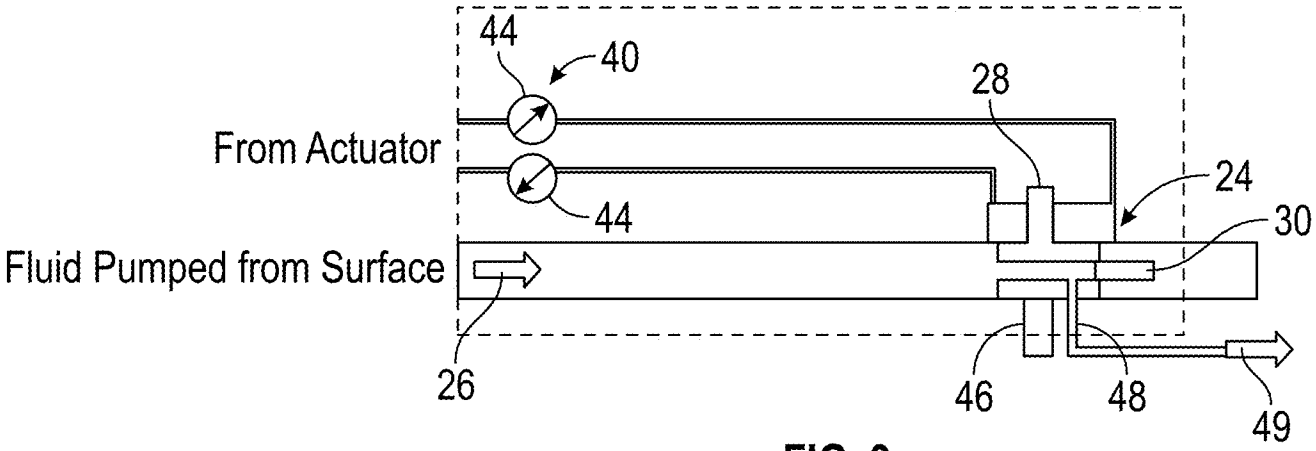
FIG. 9 is a schematic illustration of an example of the valve illustrated in FIG. 7, according to an embodiment of the disclosure.

It should be noted the packers 56 are illustrated as inflated against the surrounding wellbore wall 74, however the circulation mode may be utilized prior to expansion of packers 56. The packers 56 would then be subsequently expanded by shifting valve 24 to the packer inflation mode illustrated in FIGS. 7-9.

In the packer inflation mode, outer piston 28 remains engaged with inner piston sealing structure 30. However, lateral openings 32 become misaligned while lateral openings 34 are aligned with corresponding packer inflation passages 48. This enables circulation of fluid down through well string 22, e.g. down through coiled tubing 64, out through lateral openings 34/inflation passages 48, and to packers 56 to inflate the packers 56 into sealing engagement with the surrounding wellbore wall 74 (see arrows 49). Again, pressure sensors 44 (or other suitable sensors) may be used to monitor pressures on each side of piston 28 and to provide this differential pressure feedback to controller 60 and/or to a surface control system to enable monitoring of the position of valve 24.

It should be noted valve 24 also enables the use of a broader range of packer elements. Traditional packer setting tools employ some type of anchor to allow activation by pushing or pulling against that anchor to achieve the desired shifting between flow positions. By utilizing the electronically controlled valve 24, the anchoring requirement may be eliminated. This approach enables on-demand shifting of valve 24 without anchoring and allows use of the system described herein with a wider range of packers and in a wider range of environments.

Figure 10:
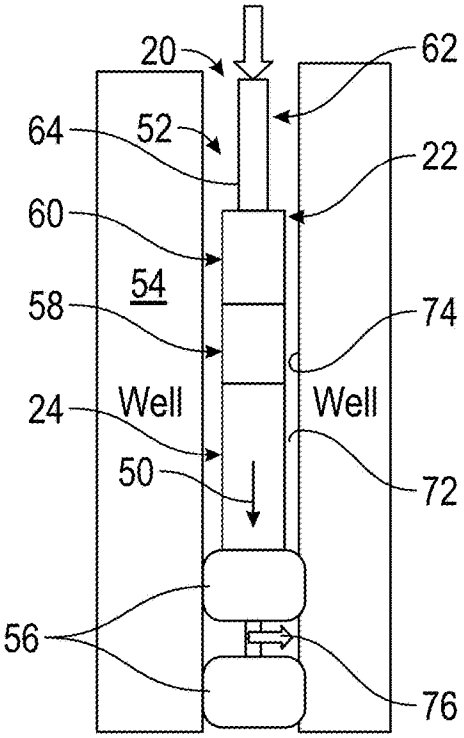
FIG. 10 is a schematic illustration of a well system having a well string deployed via coiled tubing and comprising the valve in a third operational position, according to an embodiment of the disclosure.
Figure 11:
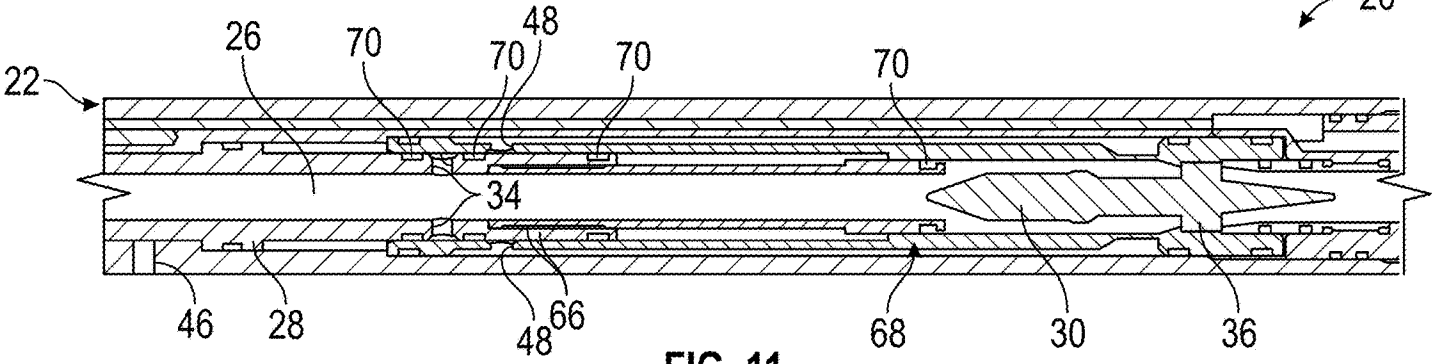
FIG. 11 is a cross-sectional illustration of an example of the valve illustrated in FIG. 10, according to an embodiment of the disclosure.
Figure 12:
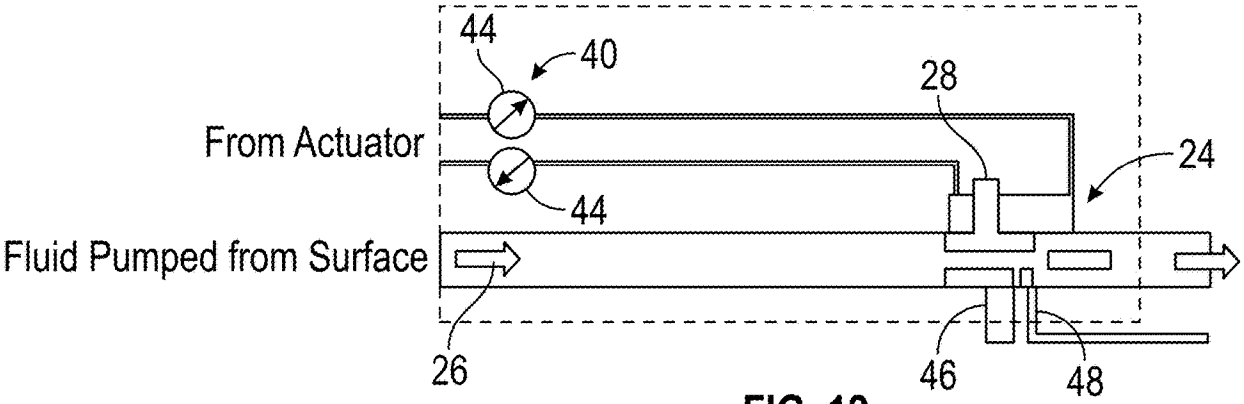
FIG. 12 is a schematic illustration of an example of the valve illustrated in FIG. 10, according to an embodiment of the disclosure.

Once packers 56 have been inflated, the valve 24 may be shifted to the well treatment mode illustrated in FIGS. 10-12. In this mode, outer piston 28 disengages from inner piston sealing structure 30 so as to allow treatment fluid to flow past the inner piston sealing structure 30 (see arrows 50) for subsequent injection into the surrounding formation. In the well treatment mode, both lateral openings 32 and lateral openings 34 become misaligned to block lateral fluid flow and to thus ensure the treatment fluid flows downhole past valve 24.

By way of example, the well treatment fluid 50 may be directed down through well string 22 past valve 24 to a position between the two packers 56 for injection into the surrounding formation 54 as indicated by arrow 76 in FIG. 10. Similar to the monitoring performed in other modes, pressure sensors 44 (or other suitable sensors) may be used to monitor pressures on each side of piston 28 and to provide this differential pressure feedback to controller 60 and/or to a surface control system to enable monitoring of the position of valve 24. It should be noted that valve 24 has been described as a three position valve, however other types of valves with other numbers of valve positions may be used to accomplish the desired transitioning between modes.

Additionally, the operation of valve 24, the number and type of modes, and the sequence of actuation may change to accommodate the parameters of a given downhole operation. In many applications, however, the ability to provide electronic control over the actuation of valve 24 greatly simplifies transitioning between operational modes while reducing the time associated with such transitions as compared to, for example, traditional use of a dropped ball to enable shifting of a piston or valve between operational modes.

Figure 13:
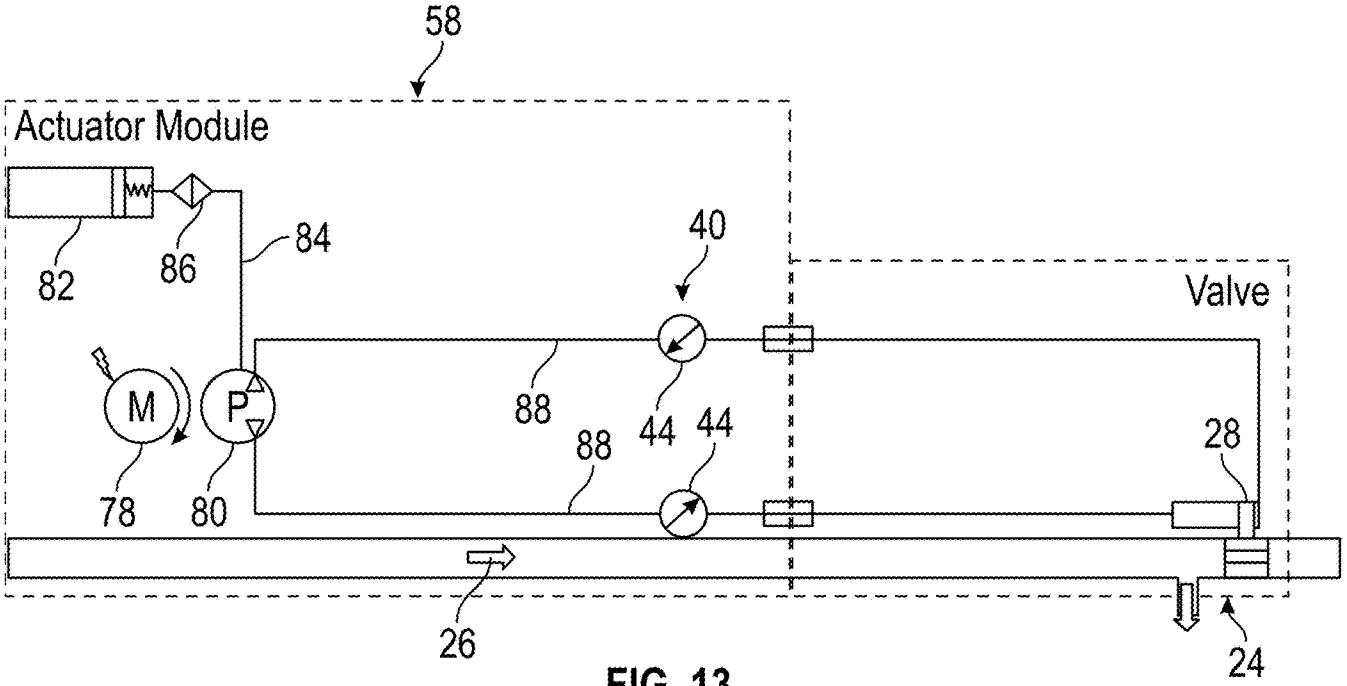
FIG. 13 is a schematic illustration of a well system having a valve which is electronically controlled via an electronically controlled actuator system, according to an embodiment of the disclosure.

One approach for providing such electronic control is illustrated in FIG. 13. In this example, the electronically controlled actuation system 58 comprises a motor 78 which may be operated according to electrical commands received from controller 60. For example, the motor 78 may be started or stopped in a clockwise direction or a counterclockwise direction. This motion, in turn, is imparted to a bidirectional pump 80 which may have suitable integrated filters and valves. In some embodiments, the pump 80 also may be fluidly coupled with a compensator 82 via a flow line 84 and a filter 86.

The pump 80 also is in operative engagement with valve 24. As illustrated, the pump 80 may be in fluid communication with piston 28 via hydraulic actuation fluid lines 88. For example, one of the fluid lines 88 may be connected to deliver hydraulic actuation fluid to one side of piston 28 while the other hydraulic fluid line 88 is connected to deliver hydraulic actuation fluid to the opposite side of piston 28 so as to enable controlled longitudinal shifting of piston 28 as described above. The hydraulic actuation fluid may be contained downhole or delivered downhole via a suitable flow line. Appropriate pressure sensors 44 and/or other sensors may be positioned along fluid lines 88 so as to monitor the pressure differential between sides of piston 28, thus providing feedback as to the operation of valve 24.

By providing the appropriate electronic control signals to motor 78, the pump 80 may be operated in one direction to drive piston 28 longitudinally in a first direction. Similarly, appropriate electronic control signals may be provided to motor 78 to cause pump to be operated in the opposite direction, thus driving piston 28 in a second or opposite direction. As a result, the valve 24 may be shifted between operational modes based on the electronic control signals provided.

Depending on the downhole application, the valve 24 may comprise a single valve or a plurality of valves. Additionally, the valve 24 may be configured to provide a variety of desired operational modes to achieve appropriate downhole tool operation and/or downhole fluid flows. The actuation system 58 may comprise various components, e.g. various motors and pumps, to control shifting of piston 28. Similarly, controller 60 may comprise a variety of computer programmable controllers or other suitable controllers able to receive command inputs and to provide appropriate control signals to actuation system 58/valve 24. The sensors 42 may comprise pressure sensors, position sensors, and/or other sensors selected to provide feedback on valve position and corresponding mode. The electrically controlled valve system may be used with many types of well strings in a variety of well applications.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system, comprising:

a valve connectable into a well string, the valve being shiftable between a plurality of modes to control flow of fluid in a downhole environment, the valve comprising an outer piston movable with respect to an inner piston sealing structure;

an actuation system connectable into the well string and operatively coupled with the valve, the actuation system being electronically controlled to cause the valve to shift to a desired mode of the plurality of modes; and a sensor system comprising a plurality of sensors positioned along the well string to provide data indicative of a current mode of the plurality of modes of the valve, wherein the plurality of sensors comprise two or more pressure sensors configured to measure respective actuating fluid pressures on both sides of the outer piston and provide differential pressure feedback based on the measured respective actuating fluid pressures to the actuation system.

2. The system as recited in claim 1, further comprising a packer selectively inflatable via fluid flow controlled by the valve.

3. The system as recited in claim 1, further comprising a first packer and a second packer selectively inflatable without anchoring, the first and second packers being inflatable via fluid flow controlled by the valve.

4. The system as recited in claim 1, wherein the plurality of modes comprises a circulation mode, a packer inflation mode, or a treatment mode, or a combination thereof.

5. The system as recited claim 1, wherein the current mode of the plurality of modes is a treatment mode, and wherein the valve is configured to enable fluid to be directed down through the well string, outwardly between a first packer and a second packer, and into a surrounding formation in response to the valve being positioned in the treatment mode.

6. The system as recited in claim 1, wherein the current mode of the plurality of modes is a circulation mode, and wherein the valve is configured to allow fluid to be directed down through the well string, through the valve, and out into an annulus between the well string and a surrounding wall of a borehole in response to the valve being positioned in the circulation mode.

7. The system as recited in claim 1, wherein the current mode of the plurality of modes is a packer inflation mode, and wherein the valve is configured to enable fluid to be directed down through the well string and to a first packer and a second packer to inflate the first packer and the second packer in response to the valve being positioned in the packer inflation mode.

8. The system as recited in claim 1, wherein the actuation system comprises a downhole electric motor coupled to a pump for delivering hydraulic actuating fluid to the valve to enable shifting of the valve to the desired mode of the plurality of modes.

9. A method, comprising:

positioning an inflatable packer along a well string sized for deployment in a wellbore;

connecting a valve along the well string to selectively enable flow of fluid to the inflatable packer during inflation of the packer;

providing the valve with additional valve positions for controlling flows of fluid in the wellbore, wherein the valve comprises an outer piston movable with respect to an inner piston sealing structure;

using an electronically controlled downhole actuation system to cause actuation of the valve between valve positions;

receiving differential pressure feedback from two or more pressure sensors configured to determine the differential pressure feedback based on respective actuating fluid pressures measured on both sides of the outer piston; and determining a current valve position of the additional valve positions based on the differential pressure feedback.

10. The method as recited in claim 9, wherein positioning comprises positioning both the inflatable packer and an additional inflatable packer along the well string, the valve controlling flow of fluid to inflate both the inflatable packer and the additional inflatable packer.

11. The method as recited in claim 9, further comprising actuating the valve to a well treatment mode to enable flow of a well treatment fluid through the valve; and performing a well treatment.

* * * * *